US006883226B2

(12) United States Patent
Herndon et al.

(10) Patent No.: US 6,883,226 B2
(45) Date of Patent: Apr. 26, 2005

(54) NEAR NET SHAPE COIL SUPPORT STRUCTURE

(75) Inventors: Larry Herndon, Florence, SC (US); William Louis Einziger, Florence, SC (US)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 10/065,038

(22) Filed: Sep. 12, 2002

(65) Prior Publication Data

US 2004/0051612 A1 Mar. 18, 2004

(51) Int. Cl.[7] ..... H01H 39/24

(52) U.S. Cl. ..... 29/599; 29/605

(58) Field of Search ..... 29/599, 605; 335/216, 335/296–306; 336/205–206

(56) References Cited

U.S. PATENT DOCUMENTS

| | | | | |
|---|---|---|---|---|
| 4,554,730 | A | * 11/1985 | Westervelt et al. | 29/605 |
| 6,078,177 | A | * 6/2000 | Petropoulos et al. | 324/318 |
| 6,157,276 | A | * 12/2000 | Hedeen et al. | 335/216 |
| 2002/0196114 | A1 | * 12/2002 | Elgin et al. | 335/299 |

* cited by examiner

*Primary Examiner*—Lincoln Donovan
(74) *Attorney, Agent, or Firm*—Bill Panagos

(57) ABSTRACT

A superconducting magnet support structure is provided. The support structure includes an exterior portion and an interior portion. The exterior portion has multiple shoulders and multiple pockets. The shoulders and pockets are dimensioned corresponding to dimensions of a superconducting magnet. The interior portion has a base coupled to the shoulders. The exterior portion and the interior portion contain roving at approximately 0° and 90° directions relative to a center axis extending through the support structure. A method of fabricating the support structure is also provided including applying an integrated multi-layer glass tape to a preformed support tooling during a wet winding process.

9 Claims, 4 Drawing Sheets

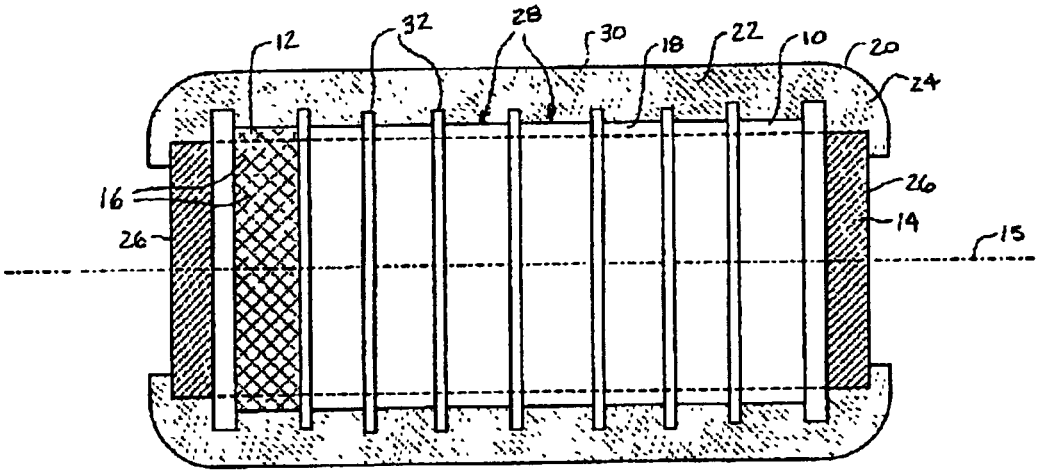
Fig. 1 - Prior Art
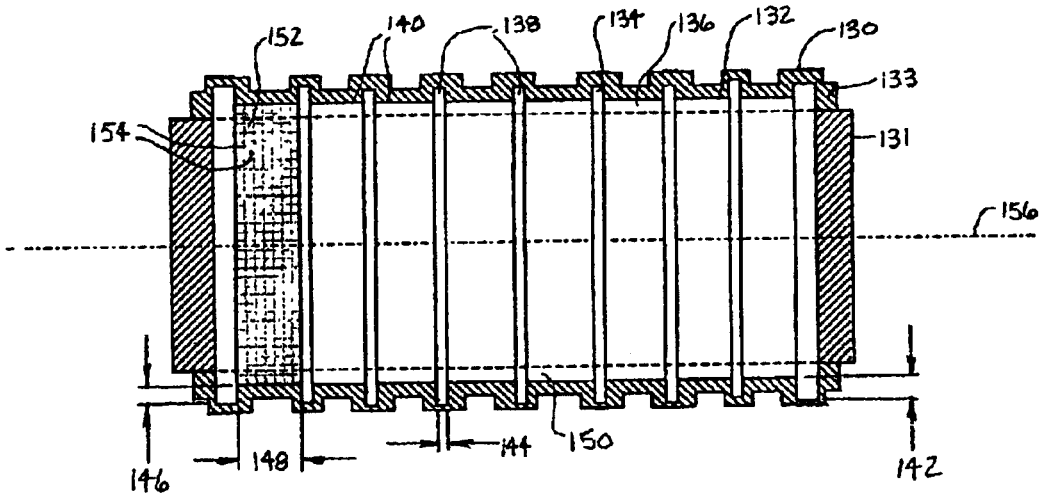
Fig. 3

NEAR NET SHAPE COIL SUPPORT STRUCTURE

BACKGROUND OF INVENTION

The present invention relates generally to a superconducting magnet coil support structure, and more particularly, to a method of fabricating a superconducting magnet coil support structure.

Currently Magnetic Resonance Imaging (MRI) systems have included a superconducting magnet that generates a temporally constant primary magnetic field. The superconducting magnet is used in conjunction with a magnetic gradient coil assembly, which is sequentially pulsed to create a sequence of controlled gradients in the static magnetic field during a MRI data gathering sequence. The superconducting magnet and the magnetic gradient coil assembly have a radio frequency (RF) shield disposed therebetween. The controlled sequential gradients are effectuated throughout a patient imaging volume (patient bore) which is coupled to at least one MRI (RF) coil or antennae. The RF coils are located between the magnetic gradient coil assembly and the patient bore.

As a part of a typical MRI, RF signals of suitable frequencies are transmitted into the patient bore. Nuclear magnetic resonance (nMR) responsive RF signals are received from the patient bore via the RF coils. Information encoded within the frequency and phase parameters of the received RF signals, by the use of a RF circuit, is processed to form visual images. These visual images represent the distribution of nMR nuclei within a cross-section or volume of the patient within the patient bore.

In current MRI systems, the superconducting magnet includes a plurality of superconducting magnet coils and is supported by a superconducting magnet coil support structure within a toroidal helium vessel. When the superconducting magnet suddenly quits carrying a charge or current, quench forces result causing the superconducting magnet coils to move. The support structure maintains the superconducting magnet coils tight and snug as to prevent movement.

Referring now to FIG. 1, a cross-sectional view of a superconducting magnet support structure 10 formed using a conventional filament winding method, is shown. In the production of current MRI systems, fiberglass roving 12, which is compatible with liquid helium is used to build the support structure 10. The support structure 10 is formed during a traditional wet winding process. During the traditional wet winding process, fiberglass roving 12 is applied to and wound around a cylindrical-shaped mandrel 14. Several layers of standard sized fiber roving are dipped into a liquid epoxy and applied to the mandrel 14, at typically ±45° angles relative to a center axis 15 extending parallel to and through the center of the mandrel 14. The fiberglass is applied at ±45° angles in order for the filament to adhere to the mandrel 14. Although, fiber roving strands 16 are illustrated over a portion of the support structure 10 they exist throughout the entire body 18 of the support structure 10. Strength of the support structure 10, in three degrees of freedom, is determined by the angle of application of the fiberglass and a ratio of the amount of fiberglass versus epoxy.

The fiberglass is allowed to cure to form an initial unmachined support structure 20 having a solid body 22. The support structure 20 is in the shape of a large diameter "green" cylinder of uniform thickness with large end caps 24 where the fiberglass roving has been wound over ends 26 of the mandrel 14. Pockets 28 are machined in an exterior side 30 of the support structure 20 to support the superconducting magnet and form the support structure 10. The dimensions and geometries of the pockets 28 correspond to the dimensions and geometries of the superconducting magnet coils. Shoulders 32 remain between pockets 28 in the support structure 10 to fill gaps between adjacent superconducting magnet coils. The closely matching dimensions and geometries allow the support structure 10 to maintain the superconducting magnet tight and snug so as to prevent freedom of movement. The end caps 24 are cut off and the support structure 10 is removed from the mandrel 14.

It is desirable as in most manufacturing processes to minimize machining time and therefore manufacturing time, decrease material waste, and increase accuracy of manufacturing processes. Due to the large amount of machining on the support structure to form the pockets, the current process is time consuming, generates a large amount of material waste, and is therefore inaccurate and inefficient.

Additionally, engineers are continuously pursuing methods for improving strength and durability of the support structure. Increased strength and durability of the support structure aids in withstanding the temperatures, movements, and environment of the superconducting magnet coils, thereby increasing life of the support structure and superconducting magnet.

It would therefore be desirable to provide a method of fabricating a superconducting magnet coil support structure for a MRI system that decreases manufacturing time, increases accuracy, and provides a support structure with increased strength and durability.

SUMMARY OF INVENTION

The present invention provides a superconducting magnet coil support structure and a method of fabricating the same. A superconducting magnet support structure is provided. The support structure includes an exterior portion and an interior portion. The exterior portion has multiple shoulders and multiple pockets. The shoulders and pockets are dimensioned corresponding to dimensions of a superconducting magnet. The interior portion has a base coupled to the shoulders. The exterior portion and the interior portion contain roving at approximately 0° and 90° directions relative to a center axis extending through the support structure.

A method of fabricating the support structure is also provided. The method includes designing a preformed support tooling for the support structure and generating design criteria. The preformed support tooling is fabricated in response to the design criteria. A wet winding process is performed to form the support structure. The wet winding process includes applying an integrated multi-layer glass tape to the preformed support tooling. The support structure is then cured and the preformed support tooling is removed from the support structure.

One of several advantages of the present invention is the ability to apply glass tape to a preformed support tooling at 0° and 90° orientations relative to the center axis of the support structure. These orientations provide increased rigidity and strength.

Another advantage of the present invention is its inherent versatility, in having the ability to alter various characteristics of the support structure by varying multiple material and fabrication parameters, the present invention is able to support a large amount of diverse applications.

Furthermore, the present invention minimizes machining time by fabricating a near net shape superconducting magnet support structure upon finishing the wet winding process. Thus, a support structure is manufactured in less time with decreased costs. The present invention is also more environmentally friendly as compared to traditional methods by producing a minimal amount of waste.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein:

FIG. 1 is a cross-sectional view of a superconducting magnet support structure formed using a conventional filament winding method;

FIG. 3 is a cross-sectional view of a superconducting magnet support structure formed in accordance with an embodiment of the present invention;

DETAILED DESCRIPTION

While the present invention is described with respect to a method of fabricating a superconducting magnet coil support structure, the present invention may be adapted to fabricate other various components including: room temperature components such as body resonator cylinders and resistive shim tubes, cryogenic components such as superconducting shim coil cylinders, and other components that are fabricated through the use of a wet-winding process.

In the following description, various operating parameters and components are described for one constructed embodiment. These specific parameters and components are included as examples and are not meant to be limiting.

Figure 2:
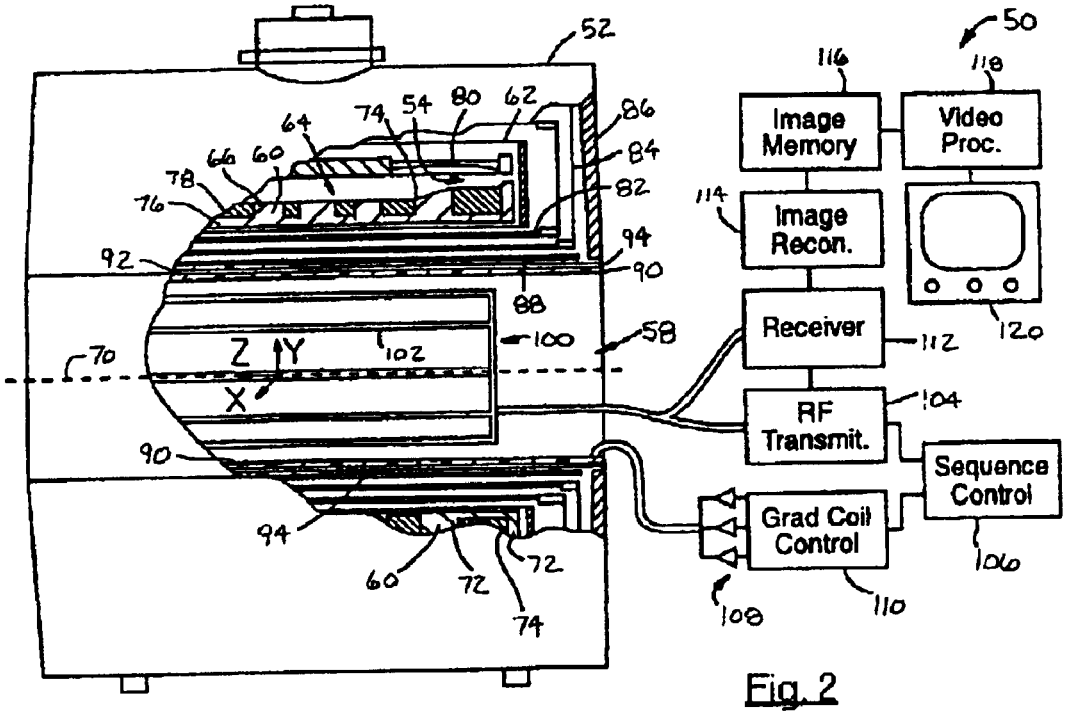
FIG. 2 is a block diagrammatic view of an MRI system in accordance with an embodiment of the present invention.

Referring now to FIG. 2, a block diagrammatic view of a MRI system 50, is shown. The MRI system 50 includes a static magnet structure 52 having a superconducting magnet 54 with a plurality of superconducting magnetic field coils 56, which generate a temporally constant magnetic field along a longitudinal z-axis of a patient bore 58. The superconducting magnet coils 56 are supported by a superconducting magnet coil support structure 60 and received in a toroidal helium vessel or can 62. The superconducting magnet coil support structure 60 provides support for static loads and allows fabrication and accurate placement of coils 56. Only one superconducting magnet 54 and one superconducting magnet coil support structure 60 are shown, however, the disclosed system may have multiple superconducting magnets and superconducting magnet coil support structures.

The superconducting magnet coil support structure 60 is preferably a solid body and includes an exterior side 64, an exterior portion 66, and an interior portion 68. The exterior side 64 is the longitudinal side farthest away from the center 70 of the patient bore 58 that supports the superconducting magnet 54. The exterior side 64 has a plurality of shoulders 72 and a plurality of pockets 74. The plurality of shoulders 72 and the plurality of pockets 74 have dimensions corresponding to dimensions of the superconducting magnet 54. The interior portion 66 is the solid body of the superconducting magnet coil support structure 60. The interior portion 66 has a base 76. The plurality of shoulders 72 are integrally connected to the external side 78 of the base 76. The interior side 68 is preferably cylindrical shaped and is the side closest to the center 70 of the patient bore 58.

A main magnetic field shield coil assembly 80 generates a magnetic field that opposes the field generated by the superconducting magnet coils 56. A first coil shield 82 surrounds the helium vessel 62 to reduce "boil-off". A second coil shield 84 surrounds the first coil shield 82. Both the first coil shield 82 and the second coil shield 84 are preferably cooled by mechanical refrigeration. The first coil shield 82 and the second coil shield 84 encases a toroidal vacuum vessel 86. The toroidal vacuum vessel 86 comprises a cylindrical member 88 that defines the patient bore 58 and extends parallel to a longitudinal axis. On an exterior side of the cylindrical member 88, which is a longitudinal side farthest away from the center 70 of the patient bore 58, is a magnetic gradient coil assembly 90. Located on an exterior side of the magnetic gradient coil assembly 90 is a cylindrical dielectric former 92. A RF shield 94 is applied to the cylindrical dielectric former 92.

The patient bore 58 has a RF coil assembly 100 mounted therein. The RF coil assembly 100 includes a primary RF coil 102 and the RF shield 94.

A RF transmitter 104 is connected to a sequence controller 106 and the primary RF coil 102. The RF transmitter 104 is preferably digital. The sequence controller 106 controls a series of current pulse generators 108 via a gradient coil controller 110 that is connected to the magnetic gradient coil assembly 90. The RF transmitter 104 in conjunction with the sequence controller 106 generates pulses of radio frequency signals for exciting and manipulating magnetic resonance in selected dipoles of a portion of the subject within the patient bore 58.

A radio frequency receiver 112 is connected with the primary RF coil 102 for demodulating magnetic resonance signals emanating from an examined portion of the subject. An image reconstruction apparatus 114 reconstructs the received magnetic resonance signals into an electronic image representation that is stored in an image memory 116. A video processor 118 converts stored electronic images into an appropriate format for display on a video monitor 120.

Referring now to FIG. 3, a cross-sectional view of a premachined superconducting magnet support structure 130 formed over a preformed support tooling 131 in accordance with an embodiment of the present invention, is shown. The premachined support structure 130 has a near net shape of a resulting support structure 132 with a "green" composite layer 133, of non-uniform thickness, which is removed through a machining process. The support structure 132 has an exterior portion 134 and an interior portion 136.

The exterior portion 134 includes a plurality of shoulders 138 and a plurality of pockets 140. Each shoulder of the plurality of shoulders 138 occupies a space located between two adjacent superconducting magnet coils 56. Each shoulder 138 has a defined shoulder height 142 and a defined shoulder width 144. The shoulder height 142 corresponds to a coil thickness of a particular coil of the plurality of superconducting magnet coils 56. The shoulder width 144 corresponds to a particular gap between superconducting magnet coils 56. Each pocket of the plurality of pockets 140 holds a particular coil of the plurality of superconducting magnet coils 56. Each pocket has a pocket depth 146 and a pocket width 148. Each pocket depth 146 is equal to the smallest adjacent spacer height and corresponds to a coil thickness of a particular coil of the plurality of superconducting magnet coils 56 that is supported by that pocket.

The interior portion 136 includes a base 150 that is coupled to the shoulders 138. The interior portion 136 as well as the exterior portion 134 are fabricated from integrated multi-layer glass tape 152 that contains roving 154. When the tape 152 is applied to the preformed support tooling 131 the tape is aligned such that the roving 154 is extended in approximately 0° and 90° directions relative to a center axis 156 extending throughout the support structure 132. Although, the tape 152 is illustrated over a single pocket of the support structure 132, the entire support structure is formed from the tape 152.

The preformed support tooling 131 is designed and fabricated for use in a wet winding process so as to form the support structure 132. The preformed support tooling 131 is preferably fabricated out of carbon steel using a method known to one skilled in the art.

Figure 4:
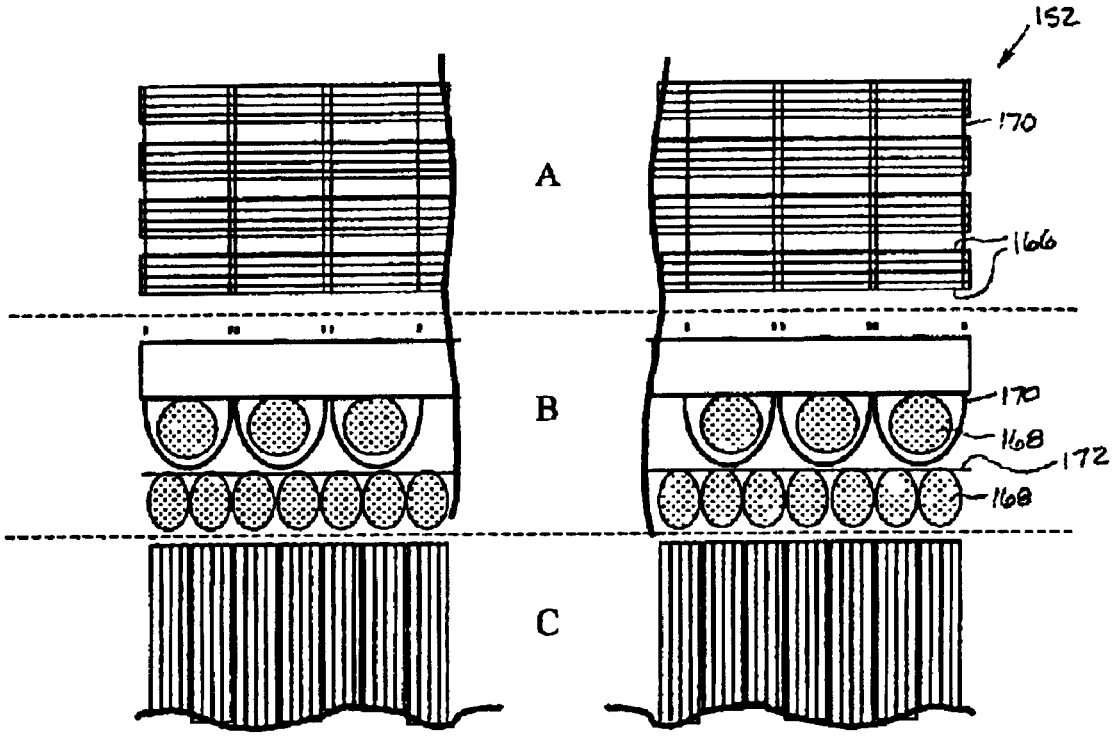
FIG. 4 is a combined top view, cross-sectional view, and bottom view of a material layered configuration within a glass tape, utilized in accordance with an embodiment of the present invention.

Referring now to FIG. 4, a top view A, a cross-sectional view B, and bottom view C of a material layered configuration of the tape 152 in accordance with an embodiment of the present invention, is shown. The tape 152 is fabricated with a non-woven cloth made from glass roving, so as not to compress the roving strands 154 locally. The tape 152 contains a first layer 160, a second layer 162, and a third layer 164. The first layer 160 is oriented such that roving 166 within the first layer 160 is at 0° relative to the center axis 156. The second layer 162 and the third layer 164 are oriented such that roving 168 within the second layer 162 and the third layer 164 is at 90° relative to the center axis 156. The first layer 160 is coupled to the second layer 162 by stitching 170. The second layer 162 is coupled to the third layer 164 via resin or adhesive 172. The tape 152 being multi-layered reduces the amount of time required to form the support structure 132 since less revolutions of the preformed support tooling 131 is required to build up the same amount of material. One example of tape 152 that may be used is Collinscraft model number A1118 35 oz. Of course, the tape-layered configuration as shown, is only one possible configuration, other configurations known in the art may be incorporated into the present invention. Although, in a preferred embodiment of the present invention the tape 152 is in four-inch wide strips, other widths of tape 152 may be implemented depending upon the application.

Figure 5:
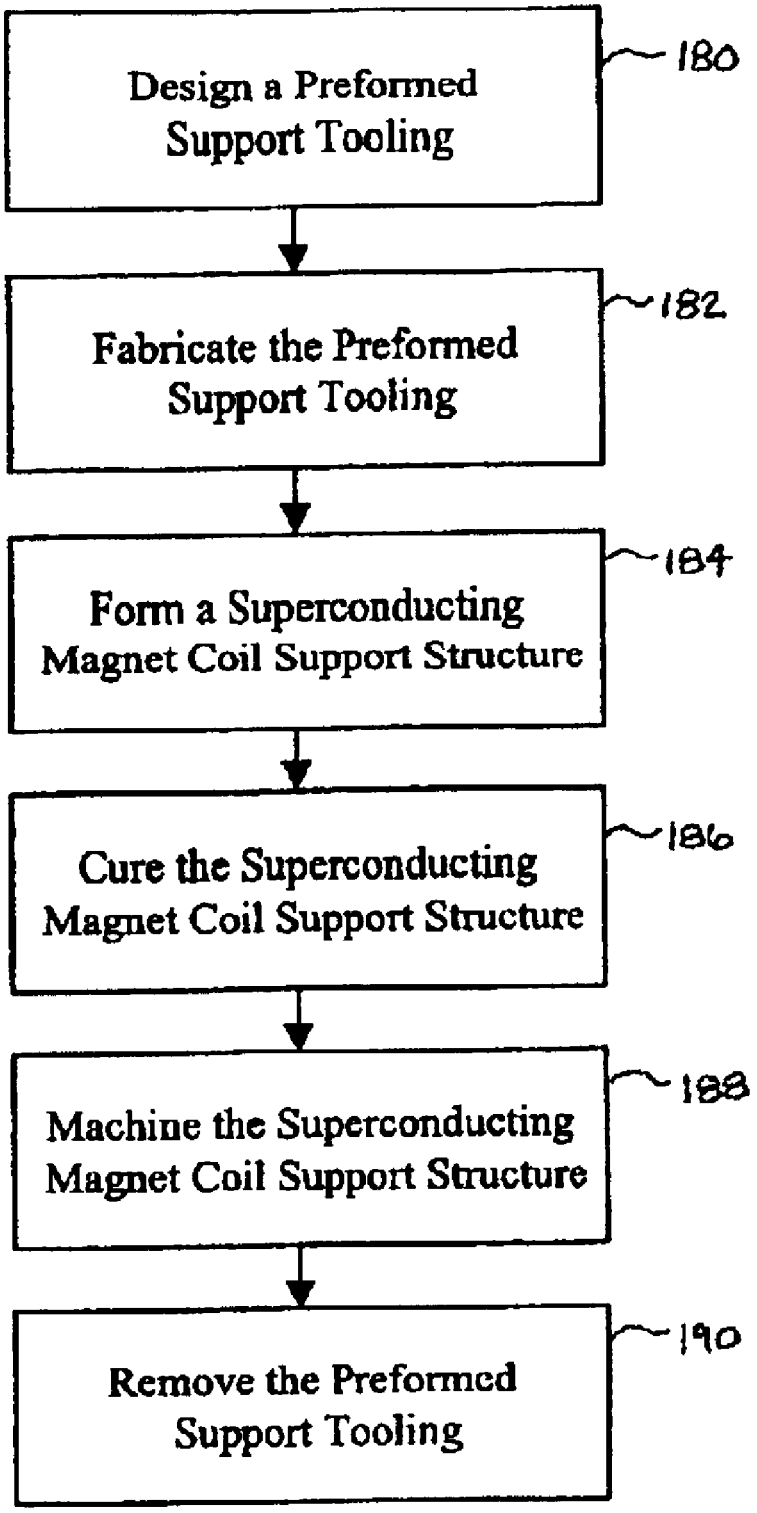
FIG. 5 is a logic flow diagram illustrating a method for fabricating a superconducting magnet coil support structure in accordance with a preferred embodiment of the present invention.

Referring now to FIG. 5, the support structure 132 is preferably fabricated as discussed in detail below.

In step 180, the preformed support tooling 131 is designed. The preformed support tooling 131 may be a simple cylindrical mandrel or may include predefined surface features in order to aid in forming the shoulders 138 and the pockets 140. Initially, the design dimensions and geometries of the superconducting magnet 54 are determined. Thereafter, the dimensions of space available for the support structure 132 in the toroidal helium vessel 62 are also determined. Based on the size of the superconducting magnet 54, a mounting configuration of the support structure 132 is determined. The support structure 132 is designed to accommodate for the dimensions and geometries of the superconducting magnet 54, the dimensions of space available, and the mounting configuration. The dimensions of the support structure 132 are used to design the dimensions of the preformed support tooling 131.

In step 182, the preformed support tooling 131 is fabricated to match the dimensions of a superconducting magnet 54. A mold release is built into or applied to the preformed support tooling 131 to ease in the removal of the preformed support tooling 131 from the support structure 132.

In step 184, the support structure 132 is formed. The support structure 132 is formed using a wet winding process. During the wet winding process dry multi-layer tape, as described above in FIG. 4, is fed through a delivery system and applied to the preformed support tooling 131, which may be rotating. The dry multi-layer tape is dipped in a resin bath at a predetermined rate and wound onto the preformed support tooling 131 at a predetermined tension. One example of resin that may be used is referred to as "thermo set", which is a two-part resin formed from mixing EPON 826 and Linride 6K. Of course other similar resin materials known in the art may be used. The resin is absorbed into the tape 152, which is porous. The base 150 is formed of uniform thickness followed by the shoulders 138 to meet design dimensions. The shoulders 138 are formed by approximately 100% overlapping of layers of tape 152. The present invention may vary the width of the tape 152 depending on the dimensions of the shoulders 138 and pockets 140 to be formed. The wet winding process may be computer controlled, including determining shoulder positions relative to the center axis 156.

Various parameters may be varied in the wet-winding process to meet desired material properties for various component applications. These parameters include tape width, roving material weight, overlap percentage, winding tension, resin soak time, as well as other parameters, known in the art. For example, for added strength and to minimize air gaps the tape strips 152 may be overlapped by approximately 50%. These parameters tailor material properties of a component to meet design requirements such as tensile strength, durability, life span of system components, temperature restraints, and other material characteristic requirements.

In step 186, the support structure 132 is cured. The support structure 132 may be placed into a vacuum to remove any remaining air within the support structure 132, thereby reducing air pockets and improving strength. The support structure 132 is cured in an oven to allow the tape 152 and resin 172 to harden and form a rigged structure.

In step 188, the support structure 130 is machined to form the support structure 132. Since the support structure 132 has been formed by applying the tape 152 at appropriate perpendicular locations on the preformed support tooling relative to the center axis 156, instead of being applied at 45° angles, the premachined support structure 130 has a near net shape of the final support structure 132. Therefore, minimum machining is required to remove the existing "green" composite material 133. The removed material 133 is also minimal as compared to the traditional wet-winding process, thereby creating minimal waste.

In step 190, the preformed support tooling 131 is removed from the support structure 132 by tapping the preformed support tooling 131 out from the support structure 132.

The orientation of roving within the glass tape and the manner as to which the glass tape is applied allow the present invention to fabricate a near net shape support structure directly from the wet winding process. Manufacturing time and costs are reduced as well as the amount of resulting waste through the use of the above described process.

The above-described apparatus and manufacturing method, to one skilled in the art, is capable of being adapted for various purposes and is not limited to applications including MRI systems, magnetic resonance spectroscopy systems, and other applications that require use of a magnet support structure. The above-described invention can also be varied without deviating from the true scope of the invention.

What is claimed is:

1. A method of fabricating a superconducting magnet support structure comprising:

generating a design criteria for a superconducting magnet;

designing a preformed support tooling for the superconducting magnet coil support structure in response to said design criteria;

providing said preformed support tooling dimensioned according to said design criteria;

applying an integrated multi-layer glass tape to said preformed support tooling by a wet winding process;

thereafter, curing said multi-layer glass tape;

machining said cured multi-layer glass tape before application of said superconducting magnet to the superconducting magnet support structure; and removing said preformed support tooling.

2. A method as in claim 1 wherein applying an integrated multi-layer glass tape comprises applying roving to said preformed support tooling at approximately 0° and 90° directions relative to a center axis extending through the resulting superconducting magnet support structure.

3. A method as in claim 1 wherein the step of providing said preformed support tooling comprises:

determining dimensions of the superconducting magnet;

determining dimensions of space available for said superconducting magnet coil support structure;

determining a mounting configuration of said superconducting magnet coil support structure;

designing dimensions of said superconducting magnet coil support structure to accommodate for said dimensions of said superconducting magnet, said dimensions of space available, and said mounting configuration; and designing dimensions of said preformed support tooling to accommodate said designing dimensions of said superconducting magnet coil support structure.

4. A method as in claim 1 wherein the step of performing a wet winding process comprises:

feeding a dry tape through a delivery system;

applying resin to said tape at a predetermined rate; and winding said tape onto said preformed support tooling.

5. A method as in claim 1 wherein said wet winding process is computer controlled.

6. A method as in claim 1 wherein applying an integrated multi-layer glass tape comprises overlapping a plurality of fiberglass tape strips.

7. A method as in claim 1 wherein applying an integrated multi-layer glass tape comprises varying the width of said integrated multi-layer glass tape.

8. A method as in claim 1 wherein applying an integrated multi-layer glass tape comprises varying at least one of the following: roving material weight, overlap percentage, winding tension, and resin soak time.

9. A superconducting magnet coil support structure formed according to the method of claim 1.

* * * * *